US006431278B1

(12) United States Patent
Guinot et al.

(10) Patent No.: US 6,431,278 B1
(45) Date of Patent: Aug. 13, 2002

(54) REDUCING SAND PRODUCTION FROM A WELL FORMATION

(75) Inventors: Frederic Guinot, Ladeveze (FR); Jun Zhao, Sugar Land; Simon G. James, Stafford, both of TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 49 days.

(21) Appl. No.: 09/680,124

(22) Filed: Oct. 5, 2000

(51) Int. Cl.[7] ..... E21B 43/17; E21B 43/26; E21B 43/267; E21B 49/00

(52) U.S. Cl. ..... 166/252.5; 166/250.1; 166/308; 166/66

(58) Field of Search ..... 166/252.5, 250.1, 166/308, 64, 66

(56) References Cited

U.S. PATENT DOCUMENTS 5,318,123 A * 6/1994 Venditto et al. ..... 166/250.1
5,360,066 A * 11/1994 Venditto et al. ..... 166/250.1
5,386,875 A * 2/1995 Venditto et al. ..... 166/280
5,497,658 A * 3/1996 Fletcher et al. ..... 166/250.01
6,283,214 B1 * 9/2001 Guinot et al. ..... 102/313

FOREIGN PATENT DOCUMENTS

WO WO 96/32567 * 10/1996 ..... E21B/43/26

* cited by examiner

*Primary Examiner*—David Bagnell
*Assistant Examiner*—Jennifer H Gay
(74) *Attorney, Agent, or Firm*—Thomas O. Mitchell; Catherine Menes; Bridgitte Jeffery

(57) ABSTRACT

A method and apparatus for performing sand control using fracturing is described. A curve is defined that correlates the percentage of flow through out-of-phase perforations (those perforations not aligned with fractures) with the fracture conductivity over formation permeability. Given a desired production flow, formation conductivity may be defined. This allows the well operator to perform the proper fracturing operation to achieve the desired fracture conductivity. Alternatively, after a well has been fractured, and sand production is observed, a critical flow rate and the corresponding drawdown pressure can be calculated to prevent sand production.

14 Claims, 7 Drawing Sheets

REDUCING SAND PRODUCTION FROM A WELL FORMATION

TECHNICAL FIELD

The invention relates to reducing sand production from well formations.

BACKGROUND

To produce hydrocarbons from a subterranean formation, a wellbore is drilled through the formation. The wellbore may be vertical, deviated, or horizontal. After the wellbore is drilled, it can be lined with a casing or liner that may be cemented to the formation. Next, a perforating gun string can be lowered to the desired depth (or desired depths), with the perforating gun string shot to create desired perforations in the surrounding casing or liner and cement sheath and to extend perforations into the surrounding formation.

Following perforation, fracturing may be performed for various purposes. One type of fracturing is hydraulic fracturing, which includes injecting fluids down the wellbore and into the formation through the perforations in the casing and formation. The fluid is injected at a sufficiently high pressure to induce the parting of the formation. Generally, the fractures extend along a direction that is perpendicular to the plane of minimum stress in the formation. Proppants are also used in the hydraulic fracturing to prop or hold open the created fractures after the hydraulic pressure used to generate the fracture is relieved. The fracture filled with the proppant creates a narrow but very conductive path through the formation to the wellbore.

Originally, hydraulic fracturing was used to stimulate the well for improved productivity. By creating the fractures, a large part of the production flow comes into the wellbore through the fractures. More recently, field experience has shown that fracturing can also be used for sand control.

In producing reservoir fluids from unconsolidated or weakly consolidated reservoirs, sand and other particulates may be produced along with the reservoir fluids (e.g., oil, gas or water). The production of formation sand and other particulates creates a number of potential problems, including lost or reduced production due to sand accumulating in the wellbore. The sand and other particulates that flow through the wellbore may also cause damage to downhole and surface equipment. Further, any sand or other particulates that are produced to the well surface poses a disposal problem, since disposal of the sand or other particulates is typically costly. Damage to the casing or liner may also occur, since production of sand leaves void spaces behind the casing which can reduce the support for the casing, causing collapse or buckling.

A common technique for controlling sand production is to use gravel pack procedures. A typical gravel pack completion includes a screen that is surrounded by gravel which filters out sand and other particulates as the produced fluids flow from the formation through the screen and into the production tubulars. However, gravel-packing procedures are associated with various shortcomings, including an increase in damage effects.

As noted above, an alternative technique for sand control is hydraulic fracturing. Fracturing reduces the drawdown pressure for a given production rate and can maintain the drawdown pressure below the critical pressure for sand production. In another application, perforating to eliminate out-of-phasing perforations following fracturing can also be used to control formation sand production by physically keeping the formation from the wellbore with the proppant pack.

Although it is known that fracturing can be used for sand control, a convenient method and apparatus has not been provided to accurately predict how effective a fracturing operation may be for sand control purposes.

SUMMARY

In general, according to one embodiment, a method of sand control in a wellbore comprises accessing representation information defining a relationship between fluid flow through one or more out-of-phase perforations and a function of fracture conductivity and formation permeability. One or more of a fracture characteristic and a fluid flow rate are selected based on the representation information to achieve sand control.

Other features and embodiments will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

Figure 1:
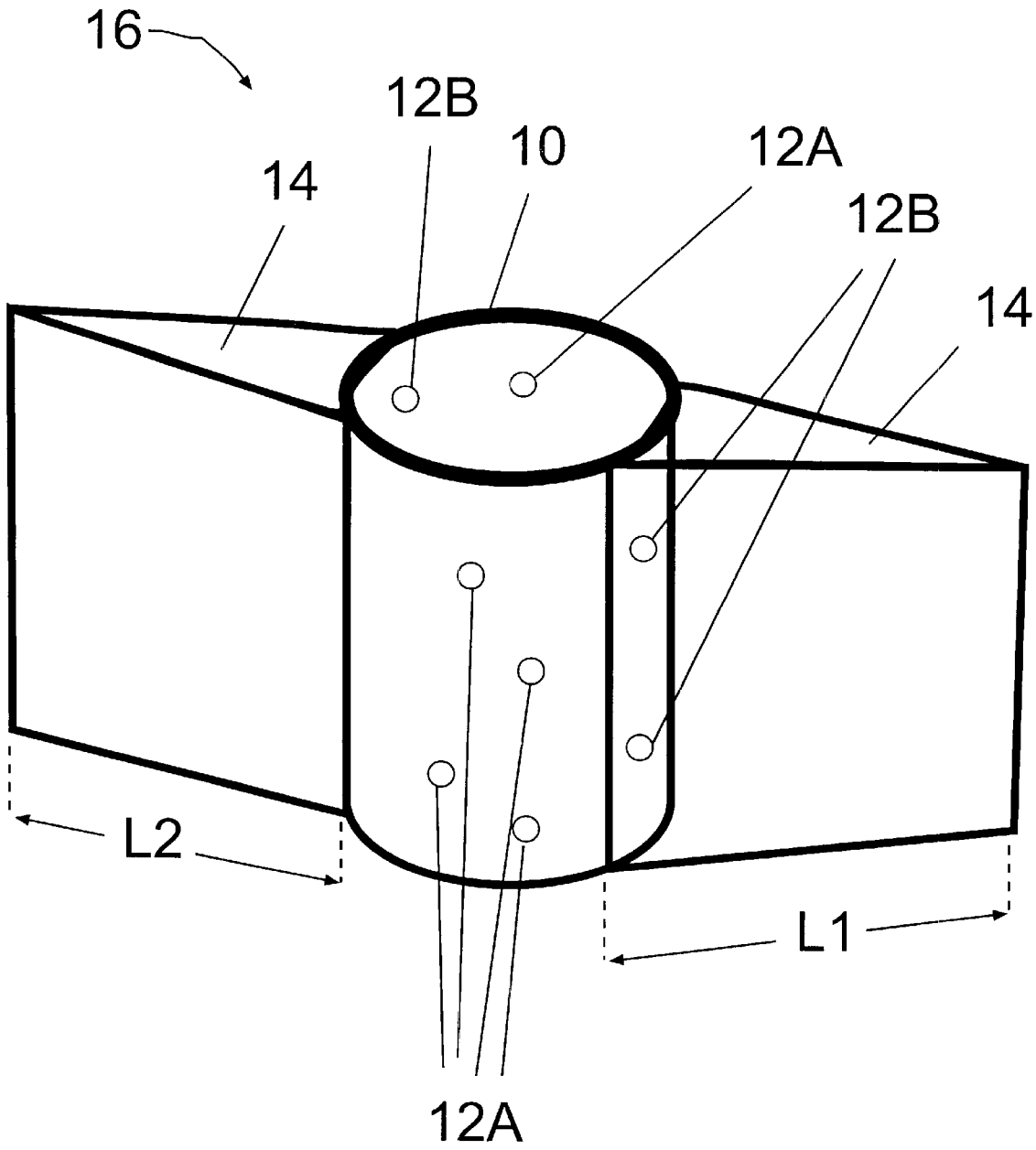
FIG. 1 is a prospective view of a wellbore and surrounding formation in which a fracture has been created.

Referring to FIG. 1, a wellbore is lined with a casing 10 (or alternatively, a liner), with perforations 12A and 12B created in the casing (and the cement sheath, if present) as well as into the surrounding formation 16. The formation 16 has been hydraulically fractured to create fractures 14 that extend up and down in a direction parallel to the axis of the wellbore. In a non-vertical wellbore portion, the geometry of the fracture may be different. The length of the two-winged fracture 14 extends into the formation along a direction that is perpendicular to the plane of minimum stress in the surrounding formation 16. The lengths L1 and L2 of the fracture wings 14 (the distance into the formation from the edge of the wellbore) are controlled by the fracturing operation. The lengths and widths of the fracture wings 14 depend on the volume of the fracturing fluid used, the injection pressures and rates, the types of proppants used, and the formation characteristics.

Proppants are mixed with the fracturing fluid carried through the perforations 12B into the formation. The proppants are deposited in the fracture to hold the fracture open after the pressure is released so that a conductive flow path is established from the formation into the wellbore.

As illustrated in FIG. 1, the perforations 12A that are not lined up with the fractures 14 are referred to as "out-of-phase perforations." On the other hand, the perforations 12B are referred to as "in-phase perforations," since they are connected to the fractures 14. Due to the higher conductivity for fluid flow through the fractures 14, most of the production fluid flow occurs through perforations 12B (as compared to perforations 12A). The proppants packed into the fractures 14 as a result of the fracturing operation limits the production of sand through the fractures 14 due to three mechanisms. First, the proppant is generally sized so that the formation sand is too big to pass through the proppant. Second, the fluid velocity from the formation through the very large area of the fracture faces is too low to transport the formation sand into the fracture, and third, the packing of the proppant into the fracture confines the formation sand at the fracture interface. However, the out-of-phase perforations remain as cavities (usually filled with debris or sand) from which sand can be produced.

Figure 2:
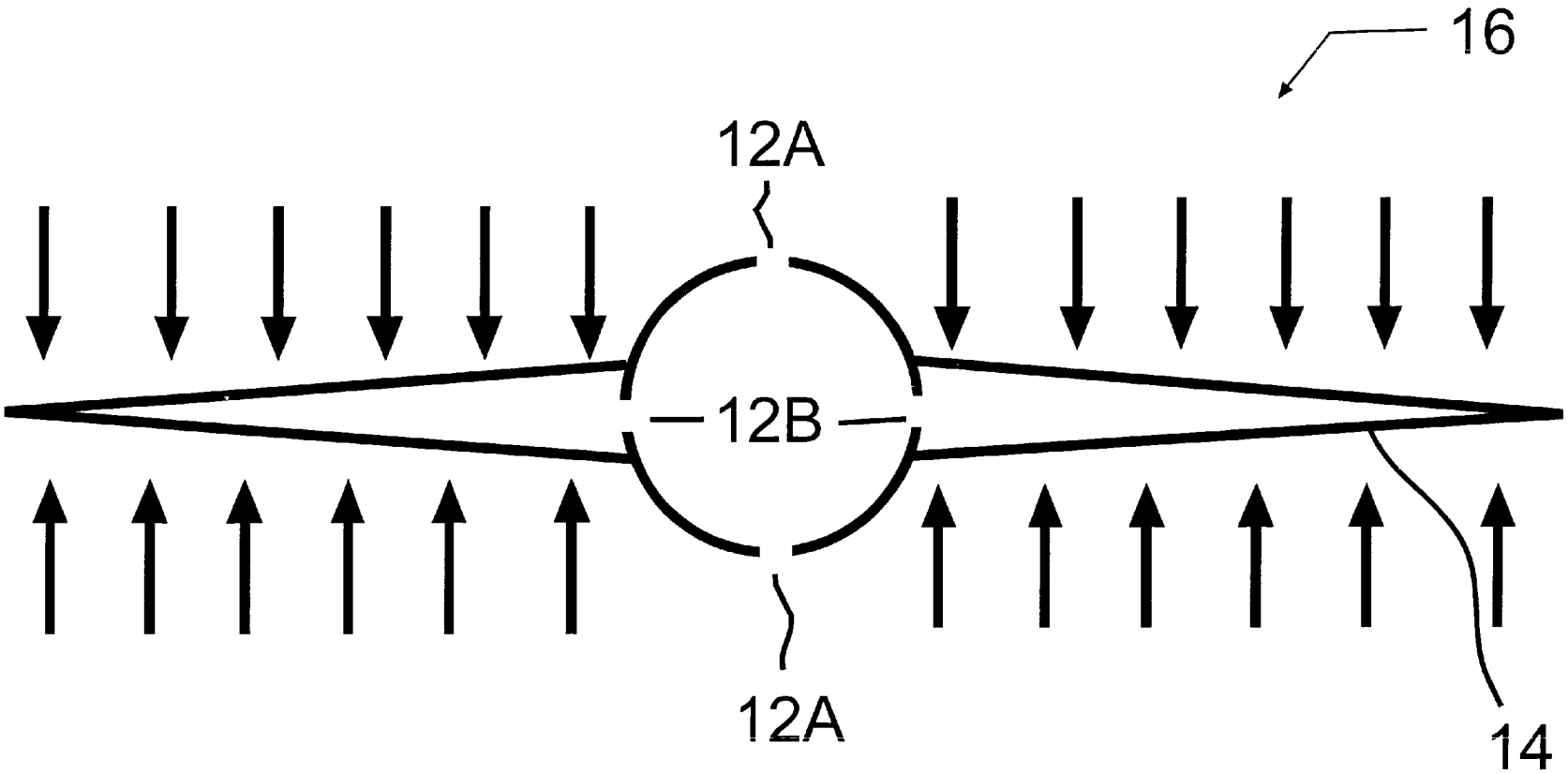
FIG. 2 illustrates fluid flow through fractures, in-phase perforations aligned with the fractures, and out-of-phase perforations not aligned with the fractures.

FIG. 2 shows the fluid flow paths from the formation 16 into the fractures 14 and through the in-phase perforations 12B as well as through the out-of-phase perforations 12A.

By considering various factors that affect the flow rate through the out-of-phase perforations, a curve can be derived that defines the relationship between a percentage of fluid flow from the out-of-phase perforations and the fracture conductivity over the permeability of the fracture. In some embodiments, the curve is an empirical fit to the results of finite difference modeling of fluid flow in a fractured reservoir. Given the relationship based on the derived curve, well operators can vary several factors to provide the desired sand control. Such factors include the fracture conductivity, a fluid flow rate through the wellbore, or the bottom hole flowing pressure.

Figure 3:
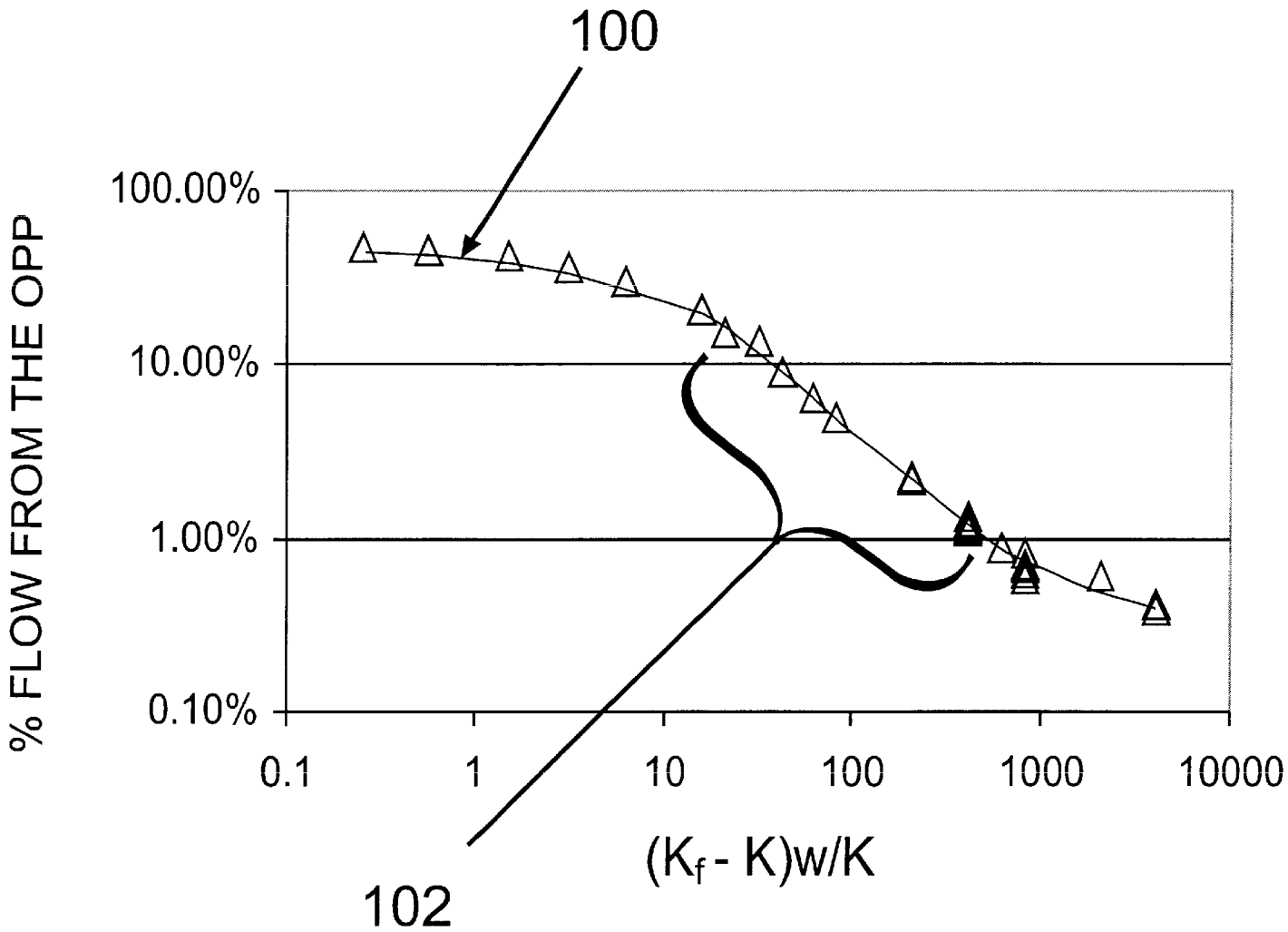
FIG. 3 is a graph of a curve that represents a relationship between fluid flow through out-of-phase perforations and fracture conductivity over formation permeability.

Referring to FIG. 3, a curve 100 (on a log-log scale) that represents the relationship between the percentage flow from the out-of-phase perforations (OPP) and the fracture conductivity over the formation permeability is illustrated. In one embodiment, the illustrated curve 100 is expressed by the following equation:

$$\begin{matrix}\text{\% Flow}\\ \text{from OPP}\end{matrix} = 2.18\left[\frac{(K_f - K)w}{K}\right]^{-0.86} \qquad \text{(Eq. 1)}$$

where $K_f$ is the fracture permeability (millidarcy or md), K is the formation permeability (md), and w is the fracture width (feet or ft). The correlation shown in FIG. 3 is valid over the linear part (generally indicated as 102) of the curve 100. The fracture width can be defined as the average width of the fracture over some predetermined length of the fracture from the wellbore (e.g., 20 to 25 feet). Alternatively, the fracture width can be selected as the width of the fracture nearest the wellbore.

As illustrated in FIG. 3, the portion 102 of the curve 100 is substantially linear in a region of low to medium fracture conductivity. Fracture conductivity is expressed by $K_f$ w. The percentage flow from the out-of-phase perforations is expressed as $Q_{opp}/Q_f$, where $Q_{opp}$ represents the total production rate from all of the out-of-phase perforations in the fractured well, and $Q_f$ represents the total production rate of the fractured well.

The fracture permeability $K_f$ is based on the type of proppants, residual fluid damage (hence fluid formulation) and flowback procedures used in a fracturing operation. For example, sand proppants usually provide relatively low fracture permeability, while ceramic and bauxite proppants usually provide higher fracture permeability. Also, the size of the proppants can also affect fracture permeability, with larger size proppants generally providing higher fracture permeability and smaller size proppants providing lower fracture permeability.

In one implementation, a representation of the curve 100, or some portion thereof, may be stored in a spreadsheet that is accessible by a user or operator. Given known values of some of the parameters, the user or operator can use the spreadsheet to calculate values for the other parameter(s) to provide for effective sand control. Thus, for example, if a target flow rate is desired, then the conductivity of the fractures can be designed so that sand is not produced. On the other hand, given a known fracture conductivity, wellbore flow rate (which translates into wellbore drawdown pressure) may be adjusted to limit sand production.

The theories underlying the curve 100 as illustrated in FIG. 3 are as follows. For a given total flow rate, the flow rate is reduced in the out-of-phase perforations when the well is fractured. The ratio $q_{opp}/q_r$ is equal to the value one when the formation is not fractured. The parameter $q_{opp}$ is the production rate from a single out-of-phase perforation in the fractured well, and the parameter $q_r$ is the production rate from a single perforation in a non-fractured well. The flow rate $q_{opp}$ in the out-of-phase perforation is reduced when one or more fractures are created, since flow is diverted from the out-of-phase perforation into the one or more fractures. As a result of the fracturing, the ratio $q_{opp}/q_r$ is reduced to less than one. Thus, a relatively simple relationship exists between flow reduction in the out-of-phase perforation due to fracturing and the amount of flow coming from the out-of-phase perforation after fracturing.

Further, the correlation expressed by the curve 100 of FIG. 3 is independent of the reservoir fluid viscosity. If formation fluids are less viscous, which makes fluid flow through the formation easier, both the out-of-phase perforations and the fractures benefit from the less viscous fluids in the same proportion. Also, the correlation is independent of the type of fluid (oil, gas or water), since fluids are dispatched in equal proportion between the out-of-phase perforations and the fractures.

A further observation is that, given a sufficiently long fracture (e.g., greater than 20 to 25 feet), the correlation expressed by the linear portion 102 of the curve 100 is independent of the fracture length. This is because the fracture conductivity near the wellbore and the permeability in the near-wellbore region of the formation are the primary factors affecting the way production is shared between the out-of-phase perforations and fractures.

Figure 4:
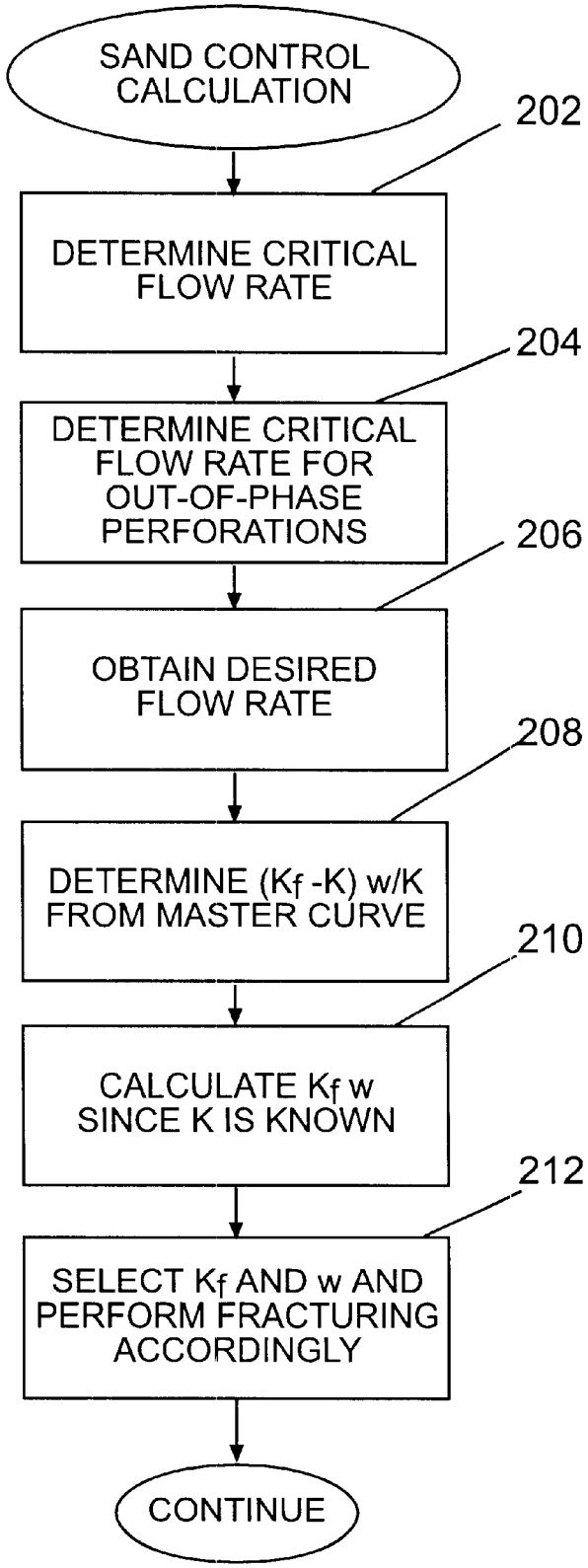
FIGS. 4 and 5 are flow diagrams of methods of performing sand control calculations in accordance with two embodiments.

Referring to FIG. 4, a process in accordance with one implementation of performing sand control calculation is performed. During testing of a non-fractured well (after perforating has been performed), production of sand in radial flow from the formation is experienced. This may be observed as sand being produced to the well surface. The critical rate $Q_{cr}$ at which the well starts producing sand is then determined (at 202). This can be accomplished, for example, by increasing the flow rate until sand production is observed. Next, the critical flow rate $q_r$ for each perforation is calculated (at 204) according to the following equation:

$$q_r = \frac{Q_{cr}}{n}, \qquad \text{(Eq. 2)}$$

where n is the total number of shots per given interval performed during perforation. Given the critical flow rate $q_r$ in each perforation, it is desired to maximize well production while maintaining the rate in the out-of-phase perforation (after fracturing is performed) below or at $q_r$. The flow rate is determined by two factors: the flow distribution and the drawdown pressure. The flow distribution can be modified by fracturing, and the drawdown pressure can be controlled by the choke setting, gas lift adjustment, or pump adjustment.

The number of holes that will be connected to a created fracture, and the number of out-of-phase perforations can be calculated using the following equations:

$$\text{Number of perforations aligned with the fracture}=\alpha n \quad \text{(Eq. 3)}$$

$$\text{Number of OPP}=(1-\alpha)n, \quad \text{(Eq. 4)}$$

$$\text{for } \phi=0, \alpha=1,$$

and $$\text{for } 0<\phi\leqq\pi,\ \alpha=\phi/\pi,$$

where $\phi$ represents the phasing angle for n perforations. From Eq. 4, for 0° and 180° phasing, the number of out-of-phase perforations is zero. However, for other phasings, the number of out-of-phase perforations is greater than zero.

The total flow rate through the out-of-phase perforations, $Q_{opp}$ , is calculated according to Eq. 5 below:

$$Q_{OPP} = Q_{cr}\left(1 - \frac{\phi}{\pi}\right). \quad \text{(Eq. 5)}$$

Eq. 5 provides that the flow rate through the out-of-phase perforations is the product of the critical flow rate $Q_{cr}$ and the ratio of the number of out-of-phase perforations to the total number of perforations.

Next, a target or a desired flow rate $Q_f$ is obtained (at 206). The target or desired well flow rate may be set by the operator of a well, for example. From the two known parameters, the ratio $Q_{OPP}/Q_f$ is calculated. Given this ratio, a user or operator can then access (at 208) the curve 100 in the chart of FIG. 3 (or a spreadsheet containing a representation of the curve 100) to obtain the parameter $(K_f-K)w/K$. In most cases, $K_f$ is much larger than K so that this can be approximated as $K_fw/K$ to simplify calculations. Since K, the formation permeability is known, the value of the product $K_fw$ can be determined (at 210). Next, the values of $K_f$ and w can be selected (at 212) to perform fracturing to achieve the minimum fracture conductivity needed to keep the flow in the out-of-phase perforations below the sand production rate. The fracture permeability $K_f$ is determined by the type of proppant fluid, additives, and flowback procedures used, and the fracture width is determined by the injection pressure, type of fracturing fluid used and the formation characteristics (chiefly the pressure of barrier beds, rock Young's modulus, in-situ stresses, and proppant embedment).

In the first case discussed above, well fracturing has not yet been performed so that the fracturing operation can be planned to provide a fracture conductivity that achieves the desired sand control. However, in a second case, it is assumed that a well has already been fractured, so that the conductivity and half-length of the fracture are known. The fracture half-length is the length of the fracture from the wellbore to the end of its conductive portion. Once the reservoir and fracture parameters are determined, a flow rate can be determined for any given drawdown pressure. The goal then is to maintain the wellbore flow rate at or below a certain level to prevent exceeding the critical rate in the out-of-phase perforations.

Figure 5:
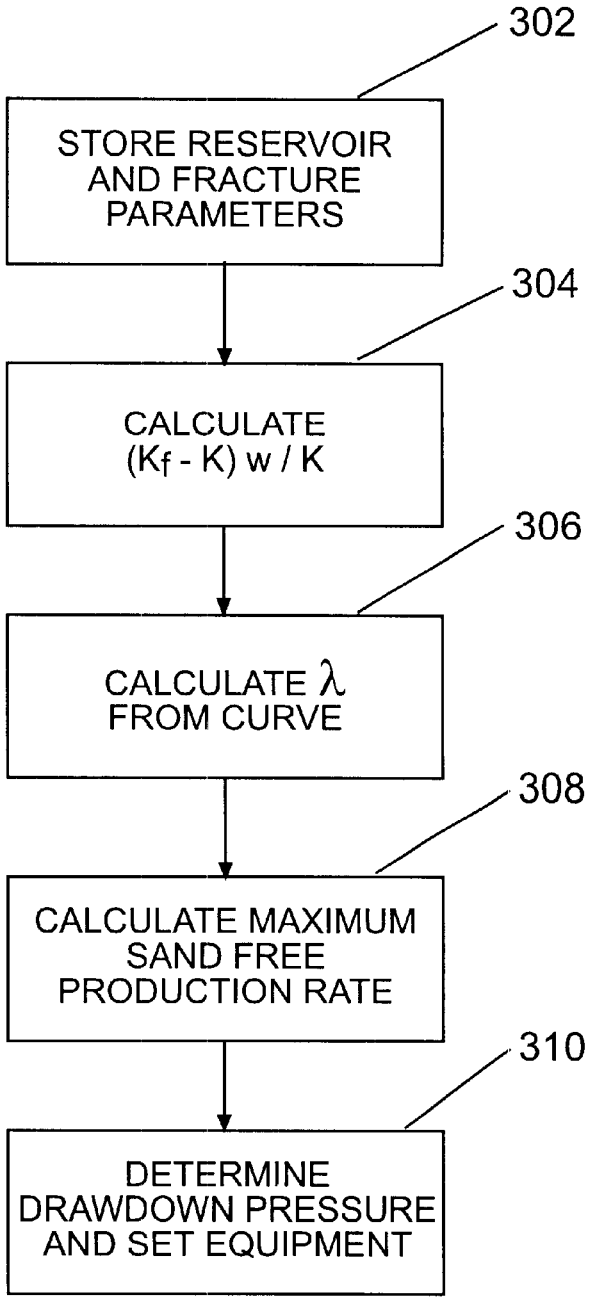

Referring to FIG. 5, the reservoir and fracture parameters are stored (at 302) in a location accessible by user or operator. Using the stored fracture permeability $K_f$, fracture width w, and formation permeability K, the value of the parameter $(K_f-K)w/K$ is calculated (at 304). The curve 100 in FIG. 3 (or a representation of the curve) is then accessed to calculate (at 306) the percentage $\lambda$ of the production coming from the out-of-phase perforations given the value of $(K_f-K)w/K$. The maximum allowable sand-free production rate $Q_{SF}$ can then be calculated (at 308) according to the following equation:

$$Q_{SF} = \frac{Q_{OPP}}{\lambda} \quad \text{(Eq. 6)}$$

From the flow rate $Q_{SF}$, the corresponding drawdown pressure can be calculated (at 310) so that the well equipment may be set accordingly to achieve the desired drawdown pressure (such as by adjusting a choke setting). The allowable drawdown for the fractured well is higher than the drawdown corresponding to the critical radial flow rate since the fractures in the formation reduce the rate of production through the out-of-phase perforations for a constant bottom hole pressure.

Figure 6:
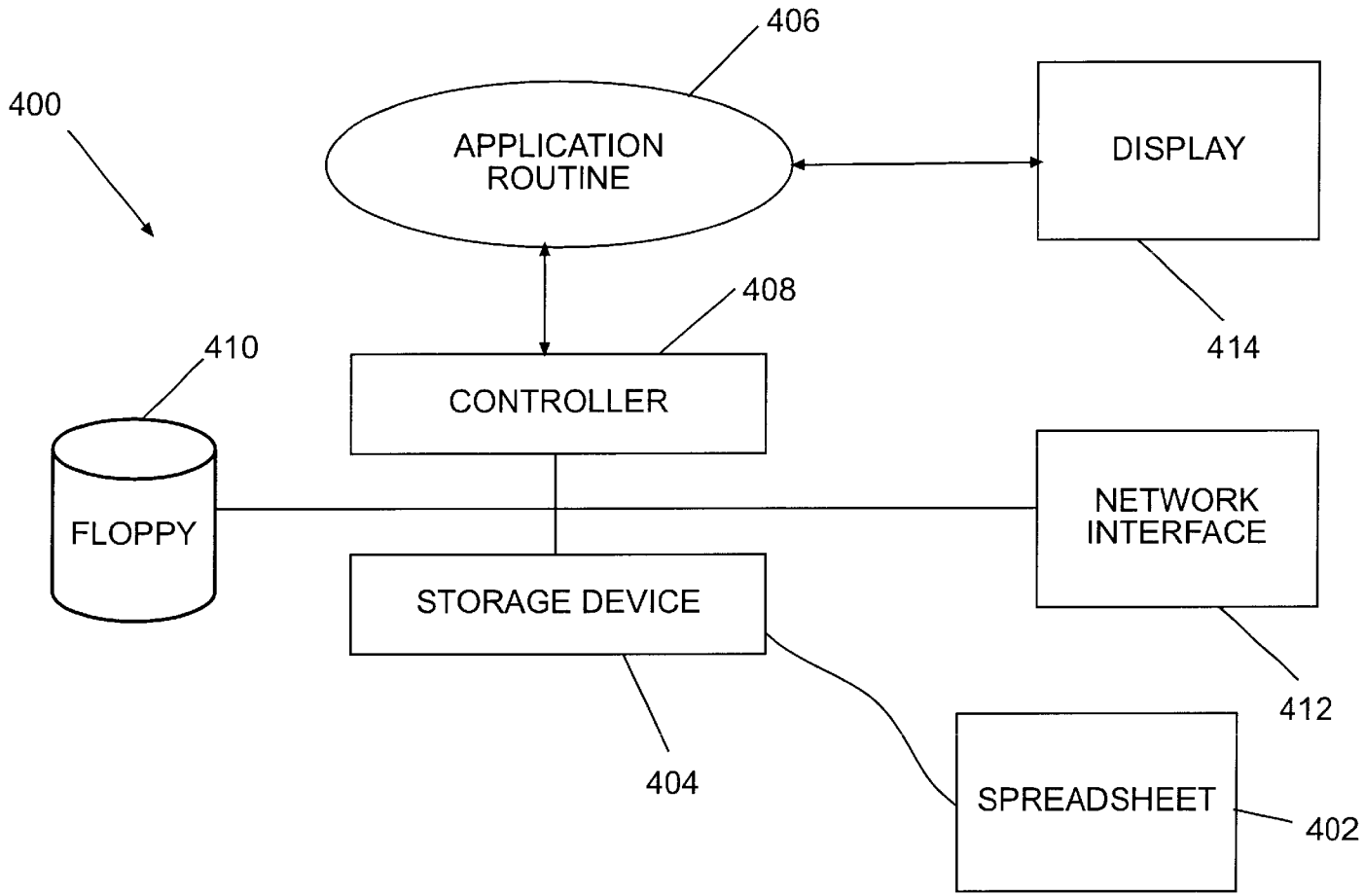
FIG. 6 is a block diagram of a system for performing sand control calculations in accordance with an embodiment.

Referring to FIG. 6, some or all of the acts in the processes of FIGS. 4 and 5 may be performed in an example computer system 400. As discussed earlier, the curve 100 may be contained in a spreadsheet 402, which is stored in a storage device 404. The spreadsheet 402 is accessible by an application routine 406, such as the software program EXCEL provided by the Microsoft Corporation, or other spreadsheet programs for performing calculations as discussed above. The application routine 406 is executable on a controller 408, which may be a microprocessor, microcontroller, or, another computing or processing device. In an alternative embodiment, another form of representation of the curve 100 may be used.

Data in the spreadsheet 402 may be communicated to the computer 400 in one of various ways. For example, the spreadsheet may be stored in a floppy diskette, and loaded into the computer system 400 through a floppy disk drive 410. Alternatively, the data in the spreadsheet 402 may be communicated over a network, which may be a local area network (LAN) or the Internet, through a network interface 412. The spreadsheet 402 itself and the results performed by the processing of the application routine 406 may be presented on a display 414.

Figure 7:
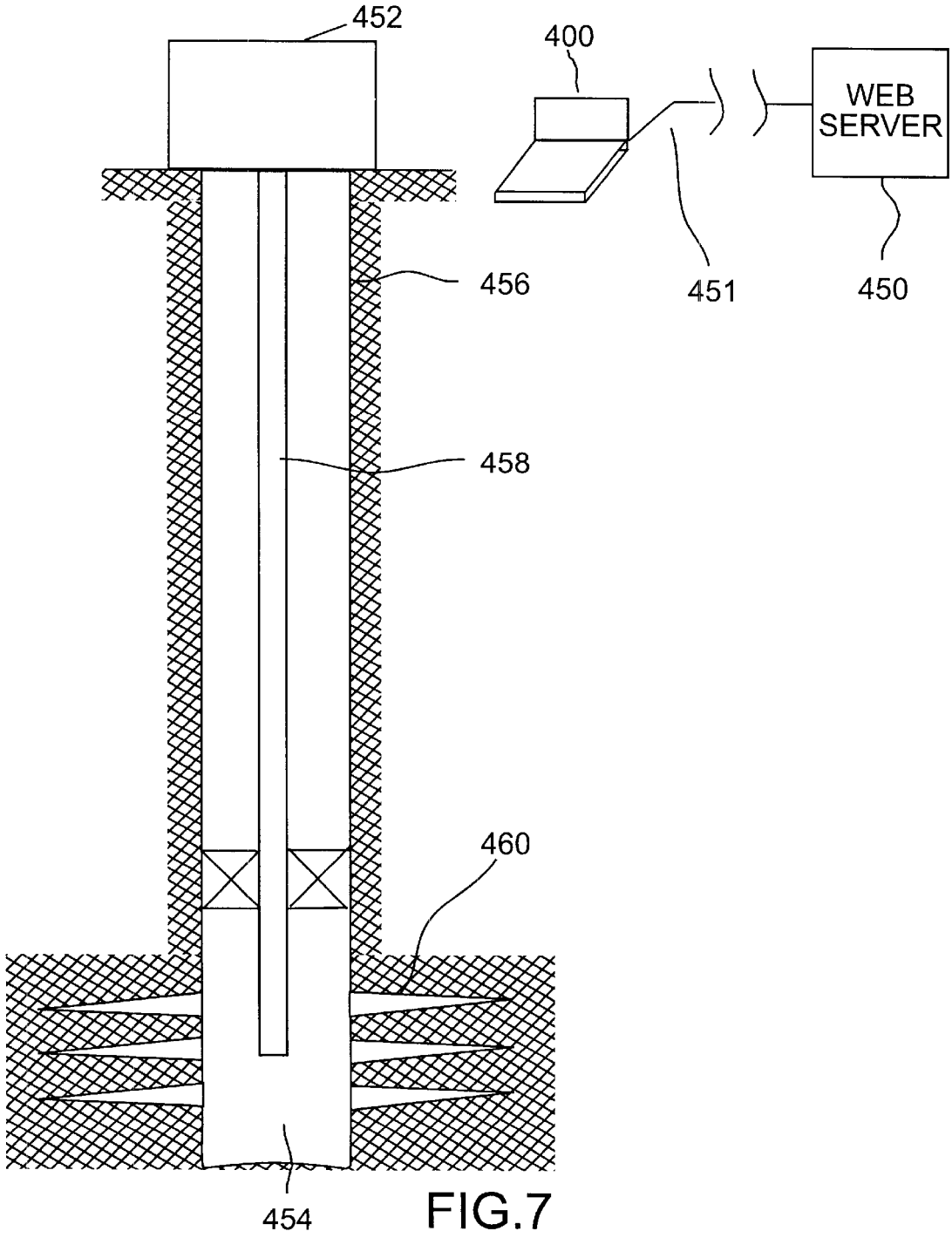
FIG. 7 illustrates an example well and associated equipment.

Referring to FIG. 7, a wellbore 454 and associated equipment are illustrated. The wellbore 454 is associated with wellhead equipment 452 and a casing 456 cemented to the wall of the wellbore. A production tubing 458 is inserted into the wellbore to receive production fluids from a formation through perforations 460. In an alternative embodiment, the wellbore can be a monobore without a production tubing. In designing a fractured well for sand control, the computer system 400 (in the form of a portable computer, for example) may be brought out to the well site. A spreadsheet or other representation of the curve 100 (FIG. 3) may be stored in the computer system 400. If needed, the computer system 400 may access a server as schematised by a line 451, e.g. a web server 450, to access the representation of the curve 100. For example, the user of the computer system 400 may be a well operator, and the entity owning the web server 450 may be a well services company. A service provided by the well services company is the information needed for designing a fractured well for sand control.

While the invention has been disclosed with respect to a limited number of embodiments, those skilled in the art will appreciate numerous modifications and variations therefrom. It is intended that the appended claims cover such modifications and variations as fall within the true spirit and scope of the invention. For example, instead of hydrocarbon-producing wells, some embodiments of the invention may be applied to water wells.

What is claimed is:

1. A method of sand control in a wellbore, comprising:

accessing representation information representing a relationship between a percentage of fluid flow through out-of-phase perforations and a function of fracture conductivity and formation permeability, said function expressed as $(K_f-K)w/K$, where $K_f$ represents a fracture permeability, K represents a formation permeability, and w represents a fracture width; and selecting one or more of a fracture characteristic and a fluid flow rate based on the representation information to achieve sand control.

2. The method of claim 1 further comprising identifying a target fluid flow rate and selecting a fracture conductivity value based on the target fluid flow rate and the representation information to achieve sand control.

3. A The method of claim 2, further comprising selecting a type of proppant to pump into the fracture to provide the selected fracture conductivity value.

4. The method of claim 1, further comprising storing the representation information in a spreadsheet.

5. The method of claim 4, further comprising receiving, in the spreadsheet, input information concerning well characteristics and outputting values for the selected one or more of the fracture characteristic and the fluid flow rate based on the input information and the representation information.

6. The method of claim 1, further comprising identifying a fracture conductivity value of a fracture in the wellbore and selecting a fluid flow rate based on the identified fracture conductivity value and the representation information.

7. The method of claim 6, further comprising identifying a drawdown pressure based on the fluid flow rate.

8. A method of sand control in a wellbore, comprising:

accessing representation information representing a relationship between a percentage of fluid flow through out-of-phase perforations and a function of fracture conductivity and formation permeability, said function approximated as $K_fw/K$, where $K_f$ represents a fracture permeability, K represents a formation permeability, and w represents a fracture width; and selecting one or more of a fracture characteristic and a fluid flow rate based on the representation information to achieve sand control.

9. The method of claim 8, further comprising identifying a fracture conductivity value of a fracture in the wellbore and selecting a fluid flow rate based on the identified fracture conductivity value and the representation information.

10. The method of claim 9, further comprising identifying a drawdown pressure based on the fluid flow rate.

11. A system for use in determining sand control for a wellbore, comprising:

a storage device storing representation information defining a relationship between fluid flow through one or more perforations that are out-of-phase and a function of the fracture conductivity and formation permeability expressed as $(K_f-K)w/K$, where $K_f$ is a fracture permeability, K is the formation permeability, and w is a fracture width; and a controller to calculate one or more of a wellbore fluid flow value, a drawdown wellbore pressure, and a fracture conductivity value based on the representation information to achieve sand control.

12. The system of claim 11, wherein the storage device stores a spreadsheet containing the representation information.

13. A system for use in determining sand control for a wellbore, comprising:

a storage device storing representation information defining a relationship between fluid flow through one or more perforations that are out-of-phase and a function of the fracture conductivity and formation permeability expressed as as $K_fw/K$, where $K_f$ is a fracture permeability, K is the formation permeability, and w is a fracture width; and a controller to calculate one or more of a wellbore fluid flow value, a drawdown wellbore pressure, and a fracture conductivity value based on the representation information to achieve sand control.

14. The system of claim 13, wherein the storage device stores a spreadsheet containing the representation information.

* * * * *